US009653782B2

(12) United States Patent
Chen et al.

(10) Patent No.: US 9,653,782 B2
(45) Date of Patent: May 16, 2017

(54) ANTENNA STRUCTURE AND WIRELESS COMMUNICATION DEVICE USING SAME

(71) Applicant: Chiun Mai Communication Systems, Inc., New Taipei (TW)

(72) Inventors: Jin-Bo Chen, New Taipei (TW); Cheng-An Chen, New Taipei (TW); Wen-Yuan Chen, New Taipei (TW); Sheng-Chieh Liang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 85 days.

(21) Appl. No.: 14/687,431

(22) Filed: Apr. 15, 2015

(65) Prior Publication Data

US 2016/0181694 A1 Jun. 23, 2016

(30) Foreign Application Priority Data

Dec. 23, 2014 (CN) ..... 2014 1 0807376

(51) Int. Cl.

| | |
|---|---|
| ***H01Q 1/24*** | (2006.01) |
| ***H01Q 5/371*** | (2015.01) |
| ***H01Q 5/378*** | (2015.01) |

(52) U.S. Cl.
CPC ..... *H01Q 1/243* (2013.01); *H01Q 5/371* (2015.01); *H01Q 5/378* (2015.01)

(58) Field of Classification Search
CPC ..... H01Q 1/243; H01Q 5/371; H01Q 5/378
USPC ..... 343/702
See application file for complete search history.

(56) References Cited

U.S. PATENT DOCUMENTS

| | | | | |
|---|---|---|---|---|
| 2011/0001673 | A1* | 1/2011 | You | H01Q 1/243 343/702 |
| 2011/0156960 | A1* | 6/2011 | Tseng | H01Q 1/243 343/700 MS |

* cited by examiner

*Primary Examiner* — Dieu H Duong
(74) *Attorney, Agent, or Firm* — Steven Reiss

(57) ABSTRACT

An antenna structure includes an antenna holder, a feed unit, a grounding unit, a first radiating unit, a second radiating unit, a third radiating unit, a parasitic unit, and a coupling unit. The feed unit and the grounding unit are positioned on the antenna holder and are spaced apart from each other. The first radiating unit and the third radiating unit are both electrically connected to the feed unit. The parasitic unit is electrically connected to the grounding unit. The first radiating unit couples with the second radiating unit and the parasitic unit. The second radiating unit further couples with the coupling unit and is grounded through the coupling unit.

16 Claims, 4 Drawing Sheets

ANTENNA STRUCTURE AND WIRELESS COMMUNICATION DEVICE USING SAME

FIELD

The subject matter herein generally relates to an antenna structure and a wireless communication device using the antenna structure.

BACKGROUND

A wireless communication device uses antennas to transmit and receive wireless signals at different frequencies for different communication systems. The structure of the antenna assembly is complicated and occupies a large space in the wireless communication device, which is inconvenient for a minimization of the wireless communication device. In addition, some other metal electronic elements, such as universal serial bus (USB), battery, electromagnetic shielding, and display, may affect the transmission of the antenna.

BRIEF DESCRIPTION OF THE DRAWINGS

Implementations of the present technology will now be described, by way of example only, with reference to the attached figures.

DETAILED DESCRIPTION

Figure 1:
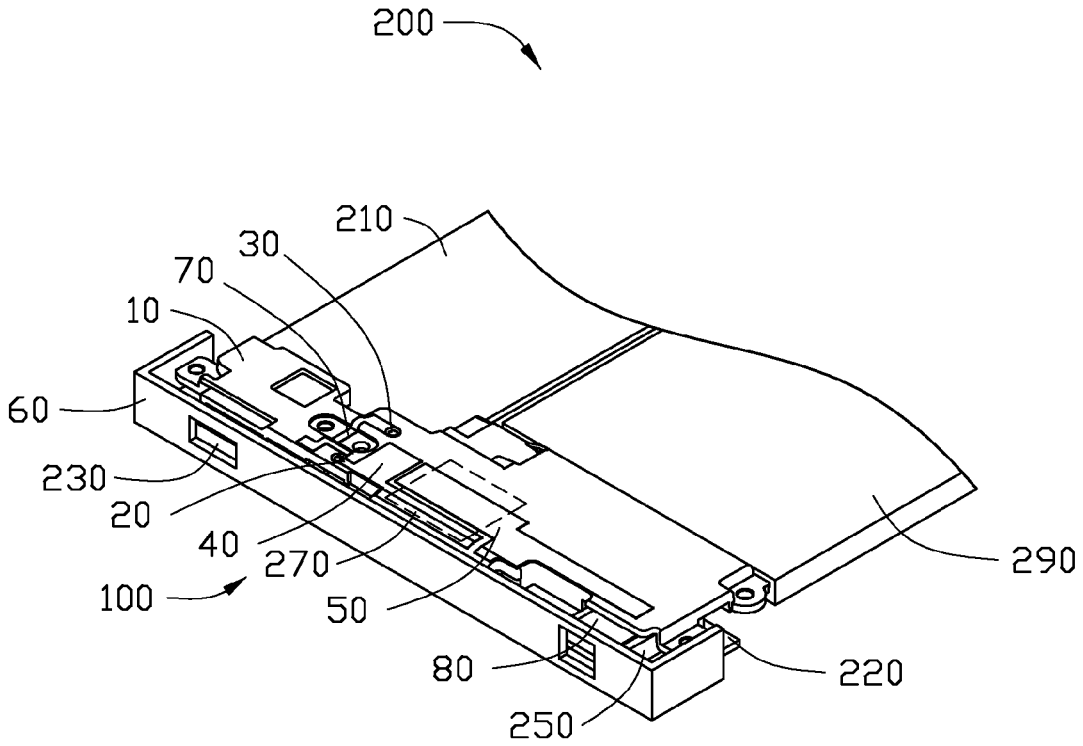
FIG. 1 is an assembled, isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 200. The wireless communication device 200 can be a mobile phone or a personal digital assistant, for example. The wireless communication device 200 includes a first baseboard 210, a second baseboard 220, and at least one electronic element. In this embodiment, the first baseboard 210 and the second baseboard 220 are both printed circuit boards of the wireless communication device 200. The second baseboard 220 is perpendicularly connected to one side of the first baseboard 210 and is collinear with the side of the first baseboard 210.

In this embodiment, the wireless communication device 200 includes at least a first element 230, a second element 250, a third element 270, and a fourth element 290. The first element 230 is a universal serial bus (USB) interface module. The second element 250 is an audio interface module. The third element 270 is a speaker module. The fourth element 290 is a battery. The first element 230 is positioned on one side of the first baseboard 210 adjacent to the second baseboard 220. The second element 250 is positioned on one side of the second baseboard 220 away from the first baseboard 210. The third element 270 is positioned on the second baseboard 220 and is positioned between the first element 230 and the second element 250. The fourth element 290 is positioned at an L-shaped area formed by the first baseboard 210 and the second baseboard 220 and is spaced apart from the first baseboard 210 and the second baseboard 220.

The antenna structure 100 includes an antenna holder 10, a feed unit 20, a grounding unit 30, a first radiating unit 40, a second radiating unit 50, a third radiating unit 60, a parasitic unit 70, and a coupling unit 80. The antenna holder 10 is positioned on the second baseboard 220 with one end of the antenna holder 10 fixed to the first baseboard 210 and the other end of the antenna holder 10 fixed to the second baseboard 220.

Figure 2:
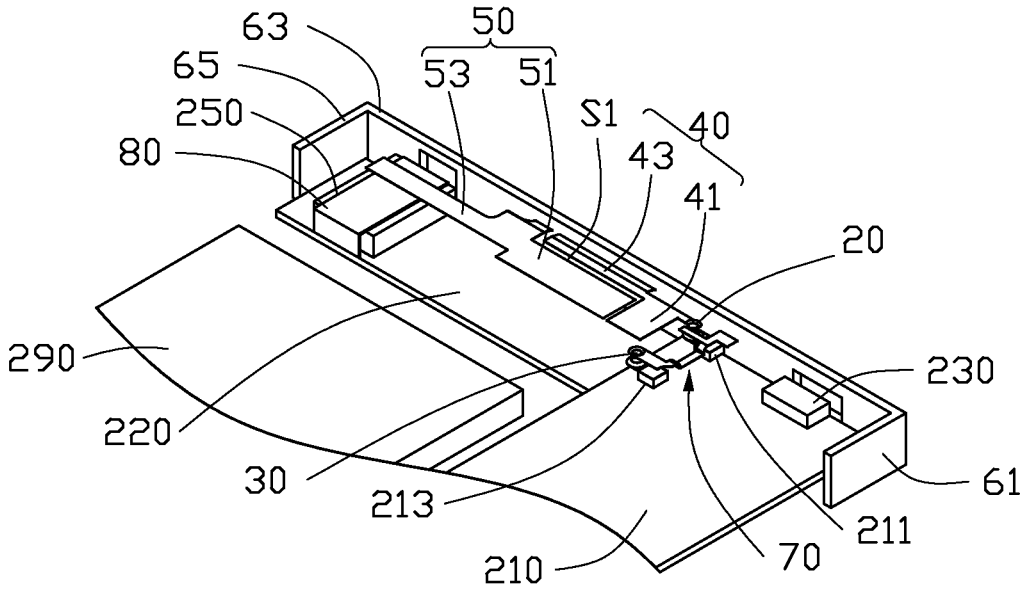
FIG. 2 is similar to FIG. 1, but shown in another angle.

FIG. 2 illustrates that a signal feed point 211 and a signal ground point 213 are positioned on the first baseboard 210. The signal feed point 211 is electrically connected to a radio frequency circuit (not shown) of the wireless communication device 200 for feeding current to the antenna structure 100. The signal ground point 213 is electrically connected to a ground plane (not shown) of the first baseboard 210 for being grounded.

The feed unit 20 and the grounding unit 30 are positioned on the antenna holder 10 and are spaced apart from each other. One end of the feed unit 20 is electrically connected to the first radiating unit 40. The other end of the feed unit 20 is electrically connected to the signal feed point 211 and is further electrically connected to the third radiating unit 60 through passing through the antenna holder 10. One end of the grounding unit 30 is electrically connected to the parasitic unit 70 and the other end of the grounding unit 30 is electrically connected to the signal ground point 213 through passing through the antenna holder 10. The first radiating unit 40 and the second radiating unit 50 are coupled with the parasitic unit 70. The second radiating unit 50 is further coupled with the coupling unit 80 and is grounded via the coupling unit 80.

The first radiating unit 40 is positioned on one surface of the antenna holder 10 and includes a first radiating body 41 and a second radiating body 43. The first radiating body 41 is substantially rectangular. The first radiating body 41 is positioned at one same side of the feed unit 20 and the grounding unit 30 and is electrically connected to the feed unit 20. The second radiating body 43 is substantially a strip. The second radiating body 42 is perpendicularly connected to one side of the first radiating body 41 adjacent to the feed unit 20. In this embodiment, the second radiating body 43 is partially protruded from one edge of the first radiating body 41 and the protruded portion of the second radiating body 43 is substantially cambered.

The second radiating unit 50 includes a first radiating sheet 51 and a second radiating sheet 53. The first radiating sheet 51 is substantially a rectangular sheet. The first radiating sheet 51 is positioned at an L-shaped space formed by the first radiating body 41 and the second radiating body 43. One end of the first radiating sheet 51 away from the second radiating body 43 is collinear with one side of the first radiating body 41 away from the second radiating body 43. In this embodiment, a first slot S1 is defined between the first radiating sheet 51 and the second radiating body 43.

The second radiating sheet 53 is substantially L-shaped. The second radiating sheet 53 is electrically connected to one side of the first radiating sheet 51 away from the first radiating body 41, extends along a direction perpendicular to the first radiating sheet 51 to be parallel with the first radiating body 41, and then extends along a horizontal direction away from the first radiating sheet 51 to be parallel with the second radiating body 43.

In this embodiment, the third radiating unit 60 can be a metallic frame of the wireless communication device 200. The third radiating unit 60 includes a first frame 61, a second frame 63, and a third frame 65. The first frame 61 and the third frame 65 are perpendicularly connected to two ends of the second frame 63, thereby forming a U-shaped structure with the second frame 63 to surround the antenna holder 10.

Figure 3:
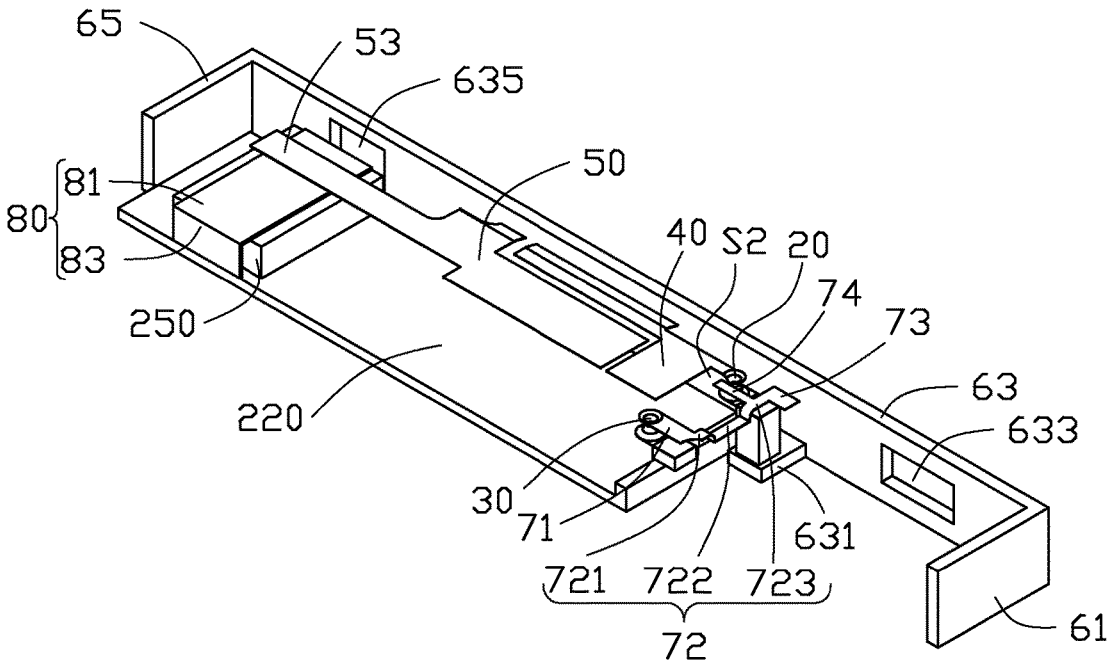
FIG. 3 is an isometric, partial view of the wireless communication device of FIG. 1.

FIG. 3 illustrates that the second frame 63 is electrically connected to the feed unit 20 through a connecting block 631 and defines a first opening 633 and a second opening 635. The first opening 633 is spaced apart from the second opening 635 and is aligned with the first element 230. The second opening 635 is aligned with the second element 250.

The parasitic unit 70 includes a first connecting portion 71, a second connecting portion 72, a third connecting portion 73, and a parasitic portion 74. The first connecting portion 71 is substantially a strip. The first connecting portion 71 is electrically connected to the grounding unit 30 and extends away from the first radiating body 41. The second connecting portion 72 is substantially U-shaped and is electrically connected between the first connecting portion 71 and the third connecting portion 73. In detail, the second connecting portion 72 includes a first connecting section 721, a second connecting section 722, and a third connecting section 723 connected in order. The first connecting section 721 is perpendicularly connected to one end of the first connecting portion 71 away from the grounding unit 30 and extends towards the second frame 63. The second connecting section 722 is perpendicularly connected between the first connecting section 721 and the third connecting section 723.

The third connecting portion 73 is substantially L-shaped and is coplanar with the first connecting portion 71. The third connecting portion 73 is connected to one end of the third connecting section 723 away from the second connecting section 722, extends towards the second frame 63 to be parallel with the first frame 61, and then extends away towards the first frame 61 to be parallel with the second frame 63.

The parasitic portion 74 is substantially a strip. The parasitic portion 74 is perpendicularly connected to a junction between the second connecting portion 72 and the third connecting portion 73, and extends towards the first radiating body 41 to be parallel with the second frame 63. In this embodiment, a second slot S2 is defined between the parasitic portion 74 and the first radiating body 41.

The coupling unit 80 includes a first coupling sheet 81 and a second coupling sheet 83. The first coupling sheet 81 is substantially rectangular. The first coupling sheet 81 is positioned on one surface of the second element 250 and is spaced apart from the second radiating sheet 53. The second coupling sheet 83 is perpendicularly connected to one end of the first coupling sheet 81 away from the second frame 63, extends towards the second baseboard 220 along one side of the second element 250, and is electrically connected to a grounding plane of the second baseboard 220.

When current is input from the feed unit 20, the feed unit 20 and the third radiating unit 60 cooperatively activate a low-frequency mode for receiving and sending signals at frequency bands of about LTE700/GSM850/EGSM900 (698-960 MHz). The first radiating unit 40 and the second radiating unit 50 are slot-coupled via the first slot S1, the second radiating unit 50 further couples with the coupling unit 80, thereby cooperatively activating a first high-frequency mode for receiving and sending signals at frequency bands of about DCS1800/PCS1900/UMTS2100 (1710-2170 MH). The parasitic unit 70 couples with the first radiating unit 40 via the second slot S2, thereby activating a second high-frequency mode for receiving and sending signal at frequency bands of about LTE2500 (2500~2690 MH).

Figure 4:
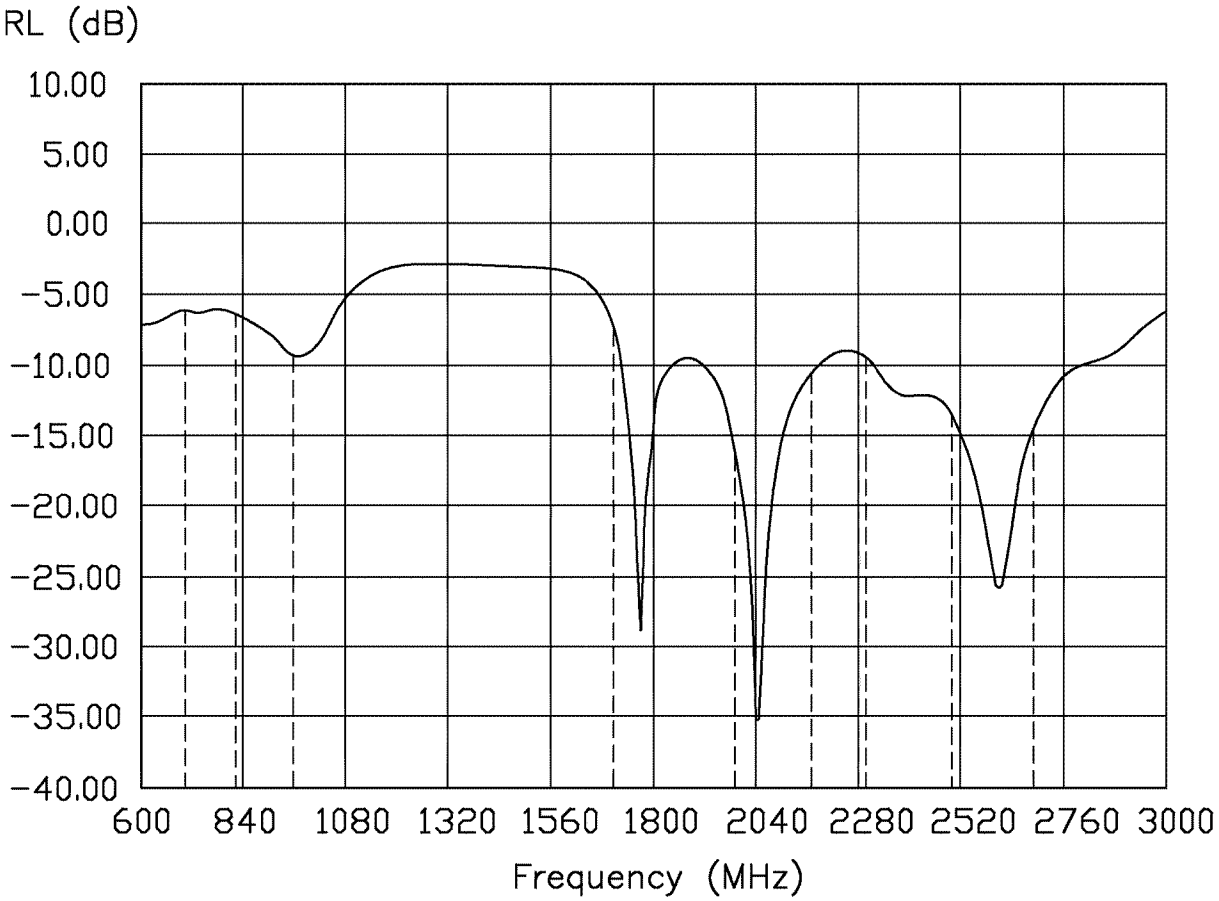
FIG. 4 is a return loss (RL) graph of the antenna structure of the wireless communication device of FIG. 1.

FIG. 4 illustrates that when a value of the RL of the antenna structure 100 is less than −6 dB, the antenna structure 100 and the wireless communication device 200 employing the antenna structure 100 can be utilized in common wireless communication systems, such as LTE700/GSM850/EGSM900 (698-960 MHz) and DCS1800/PCS1900/UMTS2100/LTE2500 (1710-2690 MHz), with exceptional communication quality.

Table 1 shows ratios of the gain and the efficiency when the antenna structure 100 receives/sends signals at different bands of about LTE700, LTE2500, GSM850, EGSM900, DCS1800, PCS1900, and UMTS2100. Clearly, it can be derived from table 1 that the antenna structure 100 and the wireless communication device 200 employing the antenna structure 100 can be utilized in common wireless communication systems and satisfy radiation requirements.

TABLE 1

| Frequency band | Ratio of the gain and the efficiency when the antenna structure sends signal | Ratio of the gain and the efficiency when the antenna structure receives signal |
|---|---|---|
| LTE700 | −4.78 | −4.65 |
| LTE2500 | −4.82 | −5.53 |
| GSM850 | −4.53 | −5.08 |
| EGSM900 | −5.20 | −5.93 |
| DCS1800 | −3.29 | −4.34 |
| PCS1900 | −4.71 | −4.95 |
| UMTS2100 | −4.83 | −5.11 |

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

an antenna holder;

a feed unit positioned on the antenna holder;

a grounding unit positioned on the antenna holder and spaced apart from the feed unit;

a first radiating unit electrically connected to the feed unit, the first radiating unit comprising a first radiating body and a second radiating body;

a second radiating unit comprising a first radiating sheet and a second radiating sheet, wherein the first radiating sheet is substantially a rectangular sheet and is positioned at a L-shaped space formed by the first radiating body and the second radiating body; the second radiating sheet is electrically connected to one side of the first radiating sheet away from the first radiating body, extends along a direction perpendicular to the first radiating sheet to be parallel with the first radiating body, and then extends along a horizontal direction away from the first radiating sheet to be parallel with the second radiating body;

a third radiating unit electrically connected to the feed unit;

a parasitic unit electrically connected to the grounding unit; and a coupling unit;

wherein the first radiating unit couples with the second radiating unit and the parasitic unit, and the second radiating unit couples with the coupling unit and is grounded through the coupling unit.

2. The antenna structure of claim 1, wherein the first radiating body is substantially rectangular and is electrically connected to the feed unit; the second radiating body is substantially a strip and is perpendicularly connected to one side of the first radiating body adjacent to the feed unit.

3. The antenna structure of claim 1, wherein the first radiating unit and the second radiating unit are slot-coupled via a first slot defined between the first radiating sheet and the second radiating body.

4. The antenna structure of claim 1, wherein the third radiating unit comprises a first frame, a second frame, and a third frame; the first frame and the third frame are perpendicularly connected to two ends of the second frame, thereby forming a U-shaped structure with the second frame to surround the antenna holder.

5. The antenna structure of claim 4, wherein the parasitic unit comprises a first connecting portion, a second connecting portion, a third connecting portion, and a parasitic portion; the first connecting portion is electrically connected to the grounding unit and extends away from the first radiating body; the second connecting portion is electrically connected between the first connecting portion and the third connecting portion; the parasitic portion is perpendicularly connected to a junction of the second connecting portion and the third connecting portion and extends towards the first radiating body.

6. The antenna structure of claim 5, wherein a second slot is defined between the parasitic portion and the first radiating body.

7. The antenna structure of claim 5, wherein the second connecting portion comprises a first connecting section, a second connecting section, and a third connecting section; the first connecting section is perpendicularly connected to one end of the first connecting portion away from the grounding unit and extends towards the second frame; the second connecting section is perpendicularly connected between the first connecting section and the third connecting section.

8. The antenna structure of claim 5, wherein the coupling unit comprises a first coupling sheet and a second coupling sheet; the first coupling sheet is substantially rectangular and is spaced apart from the second radiating sheet; one end of the second coupling sheet is perpendicularly connected to one end of the first coupling sheet away from the second frame and the other end of the second coupling sheet is grounded.

9. A wireless communication device comprising:

a metallic frame; and an antenna structure, the antenna structure comprising:

an antenna holder;

a feed unit positioned on the antenna holder and electrically connected to the metallic frame;

a grounding unit positioned on the antenna holder and spaced apart from the feed unit;

a first radiating unit electrically connected to the feed unit, the first radiating unit comprising a first radiating body and a second radiating body;

a second radiating unit comprising a first radiating sheet and a second radiating sheet, wherein the first radiating sheet is substantially a rectangular sheet and is positioned at a L-shaped space formed by the first radiating body and the second radiating body; the second radiating sheet is electrically connected to one side of the first radiating sheet away from the first radiating body, extends along a direction perpendicular to the first radiating sheet to be parallel with the first radiating body, and then extends along a horizontal direction away from the first radiating sheet to be parallel with the second radiating body;

a parasitic unit electrically connected to the grounding unit; and a coupling unit;

wherein the first radiating unit couples with the second radiating unit and the parasitic unit, and the second radiating unit couples with the coupling unit and is grounded through the coupling unit.

10. The wireless communication device of claim 9, wherein the first radiating body is substantially rectangular and is electrically connected to the feed unit; the second radiating body is substantially a strip and is perpendicularly connected to one side of the first radiating body adjacent to the feed unit.

11. The wireless communication device of claim 9, wherein the first radiating unit and the second radiating unit are slot-coupled via a first slot defined between the first radiating sheet and the second radiating body.

12. The wireless communication device of claim 9, wherein the metallic frame comprises a first frame, a second frame, and a third frame; the first frame and the third frame are perpendicularly connected to two ends of the second frame, thereby forming a U-shaped structure with the second frame to surround the antenna holder.

13. The wireless communication device of claim 12, wherein the parasitic unit comprises a first connecting portion, a second connecting portion, a third connecting portion, and a parasitic portion; the first connecting portion is electrically connected to the grounding unit and extends away from the first radiating body; the second connecting portion is electrically connected between the first connecting portion and the third connecting portion; the parasitic portion is perpendicularly connected to a junction of the second connecting portion and the third connecting portion and extends towards the first radiating body.

14. The wireless communication device of claim 13, wherein a second slot is defined between the parasitic portion and the first radiating body.

15. The wireless communication device of claim 13, wherein the second connecting portion comprises a first connecting section, a second connecting section, and a third connecting section; the first connecting section is perpendicularly connected to one end of the first connecting portion away from the grounding unit and extends towards the second frame; the second connecting section is perpendicularly connected between the first connecting section and the third connecting section.

16. The wireless communication device of claim 13, wherein the coupling unit comprises a first coupling sheet and a second coupling sheet; the first coupling sheet is substantially rectangular and is spaced apart from the second radiating sheet; one end of the second coupling sheet is perpendicularly connected to one end of the first coupling sheet away from the second frame and the other end of the second coupling sheet is grounded.

* * * * *